United States Patent [19]

Naramore

[11] Patent Number: 4,746,111

[45] Date of Patent: May 24, 1988

[54] SYSTEM FOR CONTROLLING SORTER INDEXING

[75] Inventor: Raymond A. Naramore, Penfield, N.Y.

[73] Assignee: Xerox Corporation, Stamford, Conn.

[21] Appl. No.: 872,337

[22] Filed: Jun. 9, 1986

[51] Int. Cl.[4] ..... B65H 39/11

[52] U.S. Cl. ..... 271/287; 271/292; 271/294; 270/58

[58] Field of Search ..... 271/176, 287, 288, 292, 271/293, 294, 295; 270/58

[56] References Cited

U.S. PATENT DOCUMENTS

| | | | |
|---|---|---|---|
| 3,938,801 | 2/1976 | Holliday | 271/295 X |
| 4,145,038 | 3/1979 | Mol | 270/58 |
| 4,444,491 | 4/1984 | Rinehart et al. | 355/50 |
| 4,582,421 | 4/1986 | Hamlin et al. | 271/295 X |
| 4,638,993 | 1/1987 | Granzow et al. | 271/315 |

*Primary Examiner*—Joseph J. Rolla
*Assistant Examiner*—Edward S. Ammeen
*Attorney, Agent, or Firm*—H. Fleischer; J. E. Beck; R. Zibelli

[57] ABSTRACT

A copy sheet transport is provided for integration between a copier and an indexing sorter arranged for collating the copier output into copy sets or booklets. The transport is associated with a control system for controlling the acceleration or deceleration of indexing movement of the sorter in accordance with the positional relationship of copy sheets in the transport. Sensors and a timing arrangement are devised for determining the positional relationship, and to impart correctional signals to the drive for the sorter.

1 Claim, 4 Drawing Sheets

SYSTEM FOR CONTROLLING SORTER INDEXING

This invention relates to improved document copying systems of the type which utilizes an indexing sorter for post collation of copy sheets into booklets, and in particular, for such systems which are integrated into high speed copiers or duplicating machines.

With the advent of higher speed and more sophisticated copy producing machines, printing presses, and the like, considerations as to how the mass of copies generated can best and most effectively be handled has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced.

The set of document sheets is then recycled for the reproduction of a second copy set, and so on. As each copy set is individually produced and collected at a collection station, an adhesive applying device is arranged to apply adhesive binding material along an edge side of each sheet so as to bind the set. These systems are of the precollation type wherein the document sheets are circulated by the document handling apparatus for each commencement of a reproduction run. The output for the reproduction machine will likewise be precollated in sets corresponding to the sequenced numbered document set in the document handling apparatus. The copy sheets are collected in a collated set as they are sequentially produced, and adhesive binding is applied to each sheet individually as the set is collected, as described for example in U.S. Pat. Nos. 4,540,458; 4,511,297; 4,473,425; 4,461,404; 4,406,247; and 4,140,733.

The disadvantage in these systems are two fold: the first disadvantage is that a complete document recirculation for the production of each bound copy set is necessary, thereby resulting in the speed of production being limited to the mechanical limitations in the speed of handling document sheets in the document handling device. It necessitates that the input device, the document handler, have extreme high reliability as it places the original document sheets under the severe stress of being constantly recirculated. In practice, for these systems, there appears to be a threshold in the production rate of finished copy sets. The failure rate in the document handling apparatus increases beyond acceptable limits when too high a speed of document sheet movement in the apparatus is attempted. The other disadvantage in these systems is the cumbersome and slow application of adhesive material to each of the individual sheets being collated into a set.

In order to achieve still higher rates of production of finished copy sets without the disadvantages discussed above, a reproduction system has evolved which utilizes post-collation rather than precollation. Such a system is disclosed in U.S. Pat. No. 4,444,491. The arrangement disclosed in this patent utilizes a document handling apparatus wherein a predetermined number of light images is produced for each document sheet, say for example, of page one of a multi-page document, before a successive document sheet, perhaps page two of the document, is likewise imaged. This sequencing in turn is repeated many more times when a very large number of copy sets is to be reproduced. In this manner, the mechanical movements involved in document handling are held to a minimum.

As the copy sheets are being produced in accordance with the above imaging procedure, a single array of vertically oriented collecting bins of a sorter is positioned for vertical movement in either direction to receive copy sheet output for collating the copy sheets into collated sets. The bin array or sorter in effect serves as a buffer in the production of finished copy sets. As these sets are being produced, a stapler is positioned and activated to apply one or more staples to each set as they are completed. With this arrangement, better than previously available throughput is achieved from the various apparatus utilized in the copying or duplication system having finishing capability.

The system disclosed in U.S. Pat. No. 4,444,491 utilizes a reciprocably movable array of collating bins which are driven in either direction in a vertical plane by a helical screw in conjunction with a servo drive system. The helical screw is threadedly received in a ball secured to the bin array so that upon rotation of the screw in either direction the ball, and therefore the array, are vertically moved accordingly. The servo drive system indexes the bins relative to a sheet receiving station so that as each bin is indexed to the station, a sheet will be transported to the bin. The problems evolving from this system, however, can be the relatively high number of incidences of mechanical failures due to the rapid acceleration and deceleration of the indexing movement imparted to the bin array. In addition, the rapid acceleration and deceleration movement of the bin array may cause, at times, unacceptable levels of audible noise.

It is therefore the principal object of the present invention to produce bound booklets representative of a multi-page document at the highest speed possible but at a minimum of wear and tear of mechanical parts.

The present invention includes a finishing station having a pair of staple applying devices for selectively binding booklets produced in succession comprising a linear bin array, having a series of individual bins each with an inlet for receiving individual copy sheets at a fixed sheet loading station; means supporting the bin array for vertical reciprocable movement for disposition of a selected one of the bins at the sheet loading station for loading of sheets therewithin; drive means adapted when actuated to rectilinearly move the array during the collection of sheets in collated fashion; means for transporting each collated booklet from the bins to a stapling apparatus, and a control system for the above. The control system includes a timing system arranged to sense the position of each sheet before entering a bin to calculate a correction signal in the event a sheet is sensed as being too early or too late relative to entering a bin and to apply the signal to the drive system for accelerating or decelerating the movement of the bin array accordingly.

Other objects and advantages will be apparent from the ensuing description and drawings in which.

Figure 1:
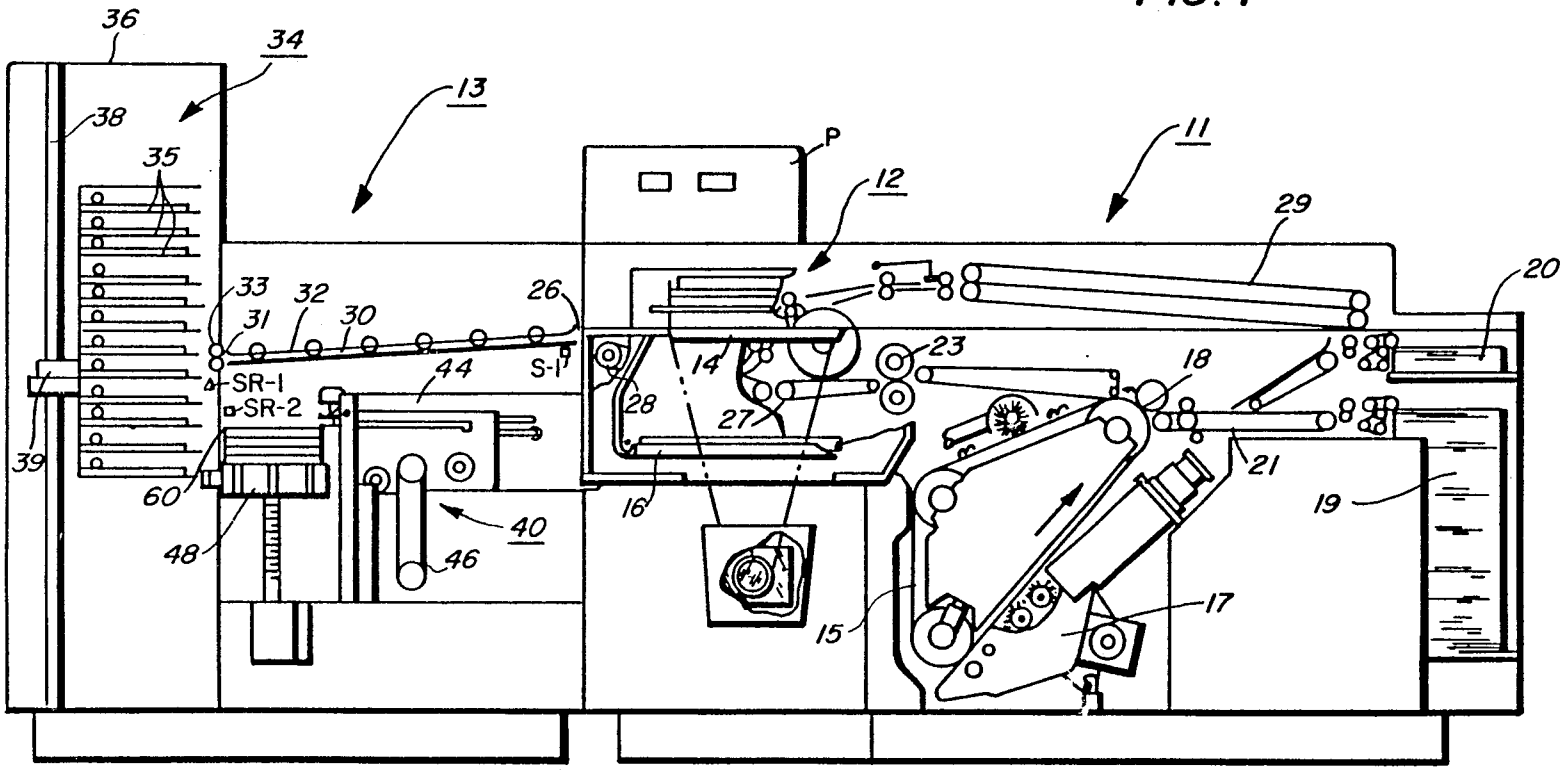
FIG. 1 is a schematic illustration of a configuration of an electrostatographic printing/finishing system employing the present invention.
Figure 2:
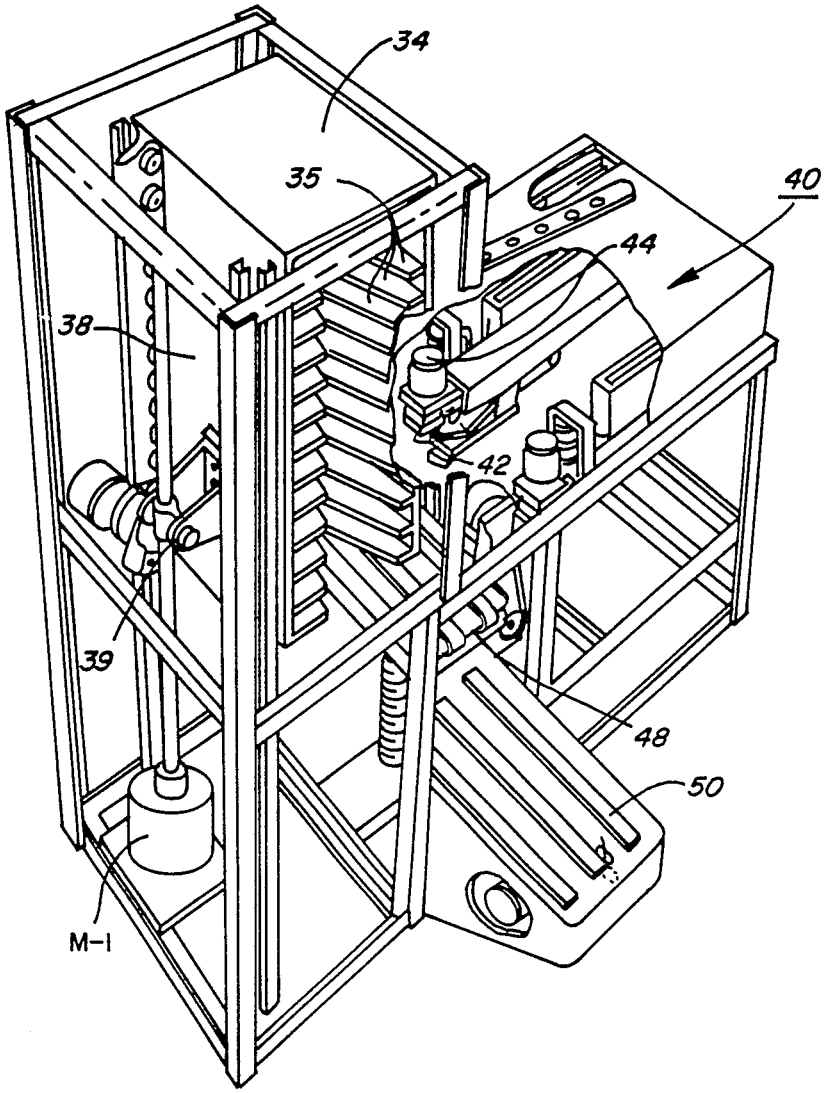
FIG. 2 is a schematic of the bin array sorter and the staple applying apparatus.

For a general understanding of a reproduction system with which the present invention may be incorporated, reference is made to FIG. 1 wherein components of an electrostatic printing/finishing system are illustrated. The printing function of the system is preferably of the xerographic type as one including a xerographic processor 11, and a document handling apparatus 12. Preferably, the processor 11 is the same as the processor in the commercial embodiment of the Xerox duplicators, models 9400® and 9500®, which utilize flash, full frame exposure, for very high speed production. Similarly, the document handling apparatus 12 is the same as those used in the same machines. It will be understood that most any other type of xerographic processor and multiple exposure document handling apparatus may be utilized. Operating in conjunction with the processor 11 and apparatus 12 is a finishing module 13 and thereby forms the reproduction system shown in FIG. 1.

As in all xerographic systems, a light image of an original to be reproduced is projected onto the sensitized surface of a xerographic photosensitive surface to form an electrostatic latent image thereon. Thereafter, the latent image is developed with toner material to form a xerographic powder image corresponding to the latent image on the photosensitive surface. The powder image is then electrostatically transferred to a record material such as a sheet of paper or the like to which it may be fused by a fusing device whereby the powder image is caused to adhere permanently to the surface of the record material.

The xerographic processor 11 is arranged as a self-contained unit having all of its processing stations located in a unitary enclosure or cabinet. The processor includes an exposure station at which an original to be reproduced is positioned on a glass exposure platen 14 for projection onto a photosensitive surface in the form of a xerographic belt 15. The original or set of individual document sheets are selectively transported by the document feed apparatus 12 one document sheet at a time to the platen 14 for exposure. After a predetermined number of exposures of each document sheet is made, the same is returned to the top of the set until the entire set has been copied. A suitable document handling apparatus of this type is described in U.S. Pat. No. 3,944,794, commonly assigned, which is hereby incorporated by reference.

Imaging light rays from each of the document sheets, which is flash illuminated by an illumination system having suitable lamps 16, are projected by means of a lens system and mirrors, onto the xerographic belt 15. The lamps 16 are connected to a suitable flashing circuit (not shown) which is controlled by the programmer for the processor in timed sequence, and in accordance with the program the operator has preset in the machine. Further details in this regard are not necessary since the Xerox 9500® Duplicator operates in this manner and is well known.

The xerographic belt 15 is mounted for movement around three parallel arranged rollers suitable mounted in the processor 11. The belt is continuously driven by a suitable motor (not shown) and at an appropriate speed. The exposure of the belt to the imaging light rays from a document sheet discharges the photoconductive layer in the area struck by light whereby there remains on the belt an electrostatic latent image corresponding to the light image projected from the document sheet. As the belt continues its movement, the electrostatic latent image passes a developing station at which there is positioned a developer apparatus 17 for developing the electrostatic latent image.

After development, the powdered image is moved to an image transfer station 18 where the developed image is transferred to a sheet of copy paper, brought from a main or auxiliary paper tray 19, 20, respectively, as each sheet is conveyed to the transfer station by a conveyor 21, which cooperates with a sheet registration device for the accurate timing and positioning of a sheet relative to the movement of a developed image on the belt 15 and the other timed events in reproduction processing. Further details of the timing relationships and related structure and events are described in U.S. Pat. Nos. 3,790,270; 3,796,486; and 3,917,396, commonly assigned, and which are incorporated herein by reference.

The copy sheet is moved in synchronism with the movement of the belt 15, and contacts the latter at the transfer station. After image transfer, the sheet of paper is stripped off the belt and transported by a vacuum conveyor in an inverted condition to a fusing station where a fuser device 23 is positioned to receive the sheet of paper for fusing the powder thereon. After fusing, the sheet is eventually transported to a finisher station to be described hereinafter to be bound by adhesive material into copy sets.

The system comprising the processor 11, the document handling apparatus 12, and the finishing module 13 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, bound or unbound; to select one of a plurality of paper trays, to condition the machine for the type of document, that is, whether one-sided or two-sided; to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8085 microprocessor manufactured by the Intel Corporation, Santa Clara, Calif., and having sufficient ROM's and RAM's for all of the necessary functions in the reproduction system.

As previously stated, copy sheets are supplied from either the main paper tray 19 or the auxiliary paper tray 20. Each tray includes a suitable elevator on which a supply of sheets rest, and a sheet feed device in operative contact with the topmost one of the sheets on the respective elevators. The feed devices are operated intermittently in timed relationship to spacing of images on the photoreceptor belt 15 and serves to advance the topmost sheet from either the supply stacks to the main paper supply transport 21.

During use, copy sheets leaving the processor 11 after exiting the fuser apparatus 23 are conveyed to an exit slot 26 by way of transports 27, 28 if the reproduction system is set for the simplex or one-sided copying. If the system has been programmed for duplex or two-sided copying, copy sheets with a first image on one side thereof will be intercepted after leaving the fuser 23 and be directed to the auxiliary tray 20 by means of a transport system 29. When the desired number of one-sided copies have been produced and delivered to the tray 20, the paper handling mechanism for the main tray 19 may be inactivated and the paper handling mechanism for the auxiliary tray 20 activated. Upon reenergization of the system, the sheets from the tray 20 are fed through the reproduction machine with the blank side of the sheets arranged to receive a transferred image in the same manner as described heretofore.

As sheets exit the slot 26, they are directed to the finishing station 13 which comprises a sorting mechanism, a stapler apparatus, and an output elevator/conveyor system. After leaving the processor 11, as shown in FIG. 1, each sheet is positioned upon a transport 30 to be further conveyed generally along the same horizontal plane as its previous path to a fixed receiving point or station 31. The transport includes a movable endless transport belt 32 upon which each sheet is placed and a plurality of loosely retained rotatable balls which rest along the belt by gravity and which coact with the belt to convey sheets therebetween. The belt 32 is driven by a motor and suitable gearing and pulleys (not shown) at a speed slightly greater than the processing speed of the processor 11 in order to add more working space between the sheets and to ensure that the final handling of copy sheets does not impede the throughput of the entire system as determined by the process speed.

At the exit slot 26, a sheet contacting switch S-1 is positioned to be actuated as each sheet enters the transport 30 for the finishing station 13. The circuit for this switch is connected to the logic in the programmer P and serves to re-set the machine clock for the finishing function so that zero time for the sheet commences when the sheet is at the reference point 31.

At the receiving or loading station 31, there is positioned a pair of contacting transport rollers 33 which receive each copy sheet within the nip therebetween for directing a sheet into a bin of an array of collecting bins, or sorter generally indicated by the reference numeral 34. In the illustrated embodiment, the array 34 includes ten horizontally disposed bins 35 arranged in a vertical column, the number of which corresponds to the predetermined number of exposures made of each document sheet while it is on the platen 14. The number of bins utilized should correspond to the total number of sheets in the paper path during the first pass of the duplex mode of operation so that machine "pitches" are not skipped. The number of exposures made for each document sheet positioning on the platen also corresponds to this total number of sheets, which for the illustrated machine is ten sheets.

The array 34 is mounted for bi-directional vertical movement within a supporting fixed frame 36. The array is arranged to be indexed in both the up and down directions past the receiving point 31 which is the bin sheet loading or receiving position. Upon operating in the copy sets or booklet mode, the array indexes downwardly one bin at a time, and as each bin becomes aligned at the station 31, movement of a copy sheet through the transport 30 and the rollers 33 is timed to enter the bins. A suitable sensor SR-1 may be positioned at the front edge of a bin when in position to receive a sheet to indicate to the system logic that this action has occurred and to enable another indexing operation.

When the array reaches its lowermost position and the uppermost bin has received a copy sheet, the document handling apparatus 12 has already removed from the platen the document sheet which initiated the production of the copy sheets, and added a successive document sheet of a set. Actually, since there are a number of images being processed in the processor 11 and a few copy sheets in the paper path being conveyed by the various transports, document sheet changes would have occurred much earlier than the time that copy sheets indicative thereof are beginning to be received in the array 34. The array will remain in the lowermost posiion until the first copy sheet of the next succeeding document sheet has been received in the uppermost bin whereupon the array will index upwardly now to permit reception of the copy sheets as before. This up and down indexing action and sorting continues until each bin 35 carries a completed, collated set of copy sheets or booklet for the set of document sheets in the document handling apparatus 12.

A set binding, stapler apparatus is arranged below the bin receiving point 31 and the transport 30. This apparatus includes means to apply one or two staples to the spline of completed sets of collated copy sheets or booklets after each has been removed from the bins, and to position the booklets on an elevator mechanism. In order to permit complete removal of the sets from all of the bins 35 in the array 34, the array must be indexed twice relative to the unloading point for the booklets. In the normal collating operating mode, the sorter/finishing arrangement handles ten copy sets or booklets at a time (a block of 10 copy sets) in cooperation with the document handling apparatus 12 as the latter exposes each document sheet ten consecutive times before advancing to the next document sheet until the complete set of document sheets has been exposed. If more than ten copy sets have been programmed, the document apparatus/sorter finisher system will complete the reproduction run in blocks of 10 copy sets. The system will continue to sort and automatically unload in blocks or multiples of 10 sets until the programmed number of sets is completed.

The bin array 34 is driven vertically in either direction by a ball screw 38 connected to the shaft of a servo index motor M-1 which is mounted to the base of the frame for the array. These movements of the array are effected by a ball 39 through which the screw 38 is threadedly related. Rotation of the screw (which is fixed against axial movement) in either direction will impart corresponding up or down movement of the ball 39, and consequently the array. Further details of the bin array 34 and all of its attendant structure, controls, and actuation thereof are not necessary for the understanding of the present invention. Such details are disclosed in U.S. Pat. No. 4,444,491, which is incorporated by reference herein.

The index motor M-1 has an encoder associated therewith preferably arranged so that 100 pulses of the encoder produces one revolution of the ball screw 38. For the particular examples to be described below, it will be assumed that the processor is capable of producing 120 copies per minute, or one copy per 0.5 seconds, and that the bin spacing of the array 34 is two inches. Ideally then with the pitch of the screw 38 being 0.5 inches, vertical linear speed of the array 34 is 4.0 inches per second, and the system provides 0.005 inches of linear motion to the bin array per encoder pulse.

After copy sheets, simplex or duplex, have been produced in the processor 11, transported by the transport 30, and collected in the bin array 34, the collected sets or booklets are now in condition to be further processed by a finishing apparatus generally indicated by the reference numeral 40. Actually, as will be discussed below, during the last series of indexing movement of the bin array when it is moving from its uppermost position to its lowermost position, if this direction is to be the last movement during sheet collection, adhesive binding of completed and remaining booklets during the finishing action may take place simultaneously with collection of sheets for the next multiple of booklets to be collated.

The finishing apparatus 40 comprises five subassemblies, each of which is programmed to operate in timed sequence with each other, with the system logic and programmer P, to be timed relative to the number of sets and copy sheets per set which were previously pre-programmed, and with the document sheet actuation of the apparatus 12. As shown in FIG. 1, the finishing apparatus comprises a set transport 42, a stapler apparatus 44, and a drive mechanism 46 for effecting activation of the apparatus 44. In conjunction with the stapling apparatus 44, the finishing station 13 also includes an elevator 48 and sets conveyor 50.

The set transport 42 is utilized to unload automatically copy sets or booklets from the bins at an unload station two copy-cycle pitches or bins below the sorter bin load station 31. A cycle time period equal to the production of two copy sheets or the collection of a copy sheet in each of two successive bins is provided. During unloading of booklets, the set transport is actuated for every other bin during each pass of the bin array. During full upper movement of the array, five of the ten pins are unloaded and the remaining bins are unloaded in the full downward movement. Further details of the set transport and the other subassemblies are discussed in detail in the above-referred to U.S. Pat. No. 4,444,491.

Figure 3:
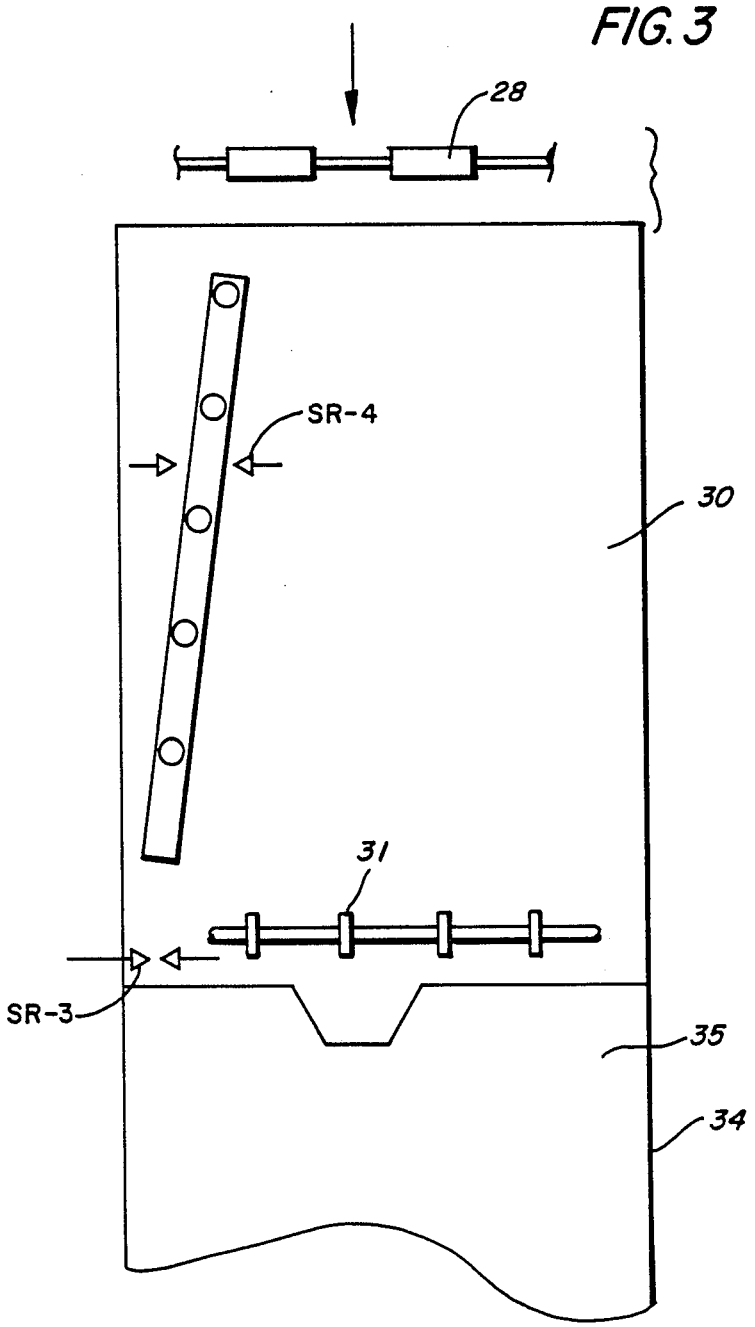
FIG. 3 is a sheet transport for conveying sheets for the system of FIG. 1.

During binding of booklets, the bin array 34 is indexed two bins at a time past an unloading station 60, see FIG. 3, to which the set transport 42 is moved for effecting removal of a booklet. A sensor SR-2 is positioned adjacent the unloading station 60 and is utilized in conjunction with the sensor SR-1 to monitor the time between zero reference of the set transport 42 as it is positioned to remove a booklet and the time the stapler 44 applies a staple(s) to the spline of a booklet. This timing data is transmitted to servo controllers associated with the microprocessor in the programmer P.

These servo controllers provide complete motion control for relatively heavy apparatus which are actuated from a stopped position, accelerated to high speed activation, and then brought to a stop position, all at a continuous high rate of cyclic action. Therefore, accurate velocity profile control is necessary for each servo, and constant position monitoring utilizing the switch S-1 and the sensors SR-1,SR-2 is provided.

The elevator 48 is utilized to collect into a pile the bound or unbound sets or stacks of copy sheets for delivery to the operator by way of the conveyor 50. The details of the elevator 48 and the cooperative controls therefor are not necessary for the present invention since these subassemblies are adequately disclosed in the above-referred to U.S. Pat. No. 4,444,491.

The present invention is directed to a timing and control system arranged for timing each sheet of paper placed upon the transport 30, to compare this timing to the nominal velocity of the vertical movement of the bin array 34, and to effect acceleration or deceleration of the movement of the bin array relative to that nominal velocity so that entrance of each sheet into a bin will be assured in the event sheets leave the processor 11 in randomly-timed fashion.

In the practice of the invention, a method of sheet-to-sheet timing is performed as close as possible to the bin array 34 so that the timing of the first sheet relative to the second sheet is known before the first sheet reaches the sensor SR-1, the latter sensor serving in the capacity of a bin fill sensor.

Sheet-to-sheet timing is accomplished with the use of a sheet sensor SR-4 mounted in the transport 30. When a sheet reaches the timing sensor SR-4, a clock associated with the Programmer P starts counting until the second sheet reaches the same sensor. The effect of this timing, if within permissible limits, is utilized to calculate a new bin array velocity and is stored in the system memory. As is well known in the sheet transporting and handling art, because of machine tolerances and ambient conditions, positional timing of sheets at any one point may vary considerably, perhaps as much as three inches, especially for copiers capable of producing 120 copies per minute and higher. In conventional copying apparatus which utilize vertically moving sorters, the amount of mis-timing of sheets being the extremes of this permissible limits will accumulate until a sheet is moved toward the sorter when a bin is not in position to receive it, thereby causing a jam.

In the present invention, if the calculated timing between sheets is out of the permissible limits, the machines will be shut down. For example, assuming that the permissible limits is such that the sheet timing may be between 0.470 seconds and 0.550 seconds, if sheet timing is $<0.470$ seconds or $>0.550$ seconds, the array will be stopped as will the entire system. On the other hand, if the sheet timing is $>0.470$ seconds and $<0.550$ seconds, a new bin array velocity is calculated and stored in the Programmer memory. When a first sheet reaches the bin fill sensor SR-3, the bin array velocity will change to the stored value.

When sheet N reaches the timing sensor SR-4, the machine clock is started and continued until sheet N+1 reaches the sensor. At that time, the clock is reset to begin counting from sheet N+1 to N+2. With the time from sheet N to N+1 known, the velocity that the bin array must move to be in position for sheet N+1 is calculated, which is 2.0 inches (bin to bin distance) divided by time (T). For any sheet after the first sheet of a reproduction job, the bin array will not assume any given position due to positional errors caused by the servo drive velocity tolerances.

These errors are minimized by monitoring the servo motor by counting encoder pulses (each pulse=0.005 inch of bin movement) associated with the servo motor M-1. An error in bin array position (E) is the distance the bin has moved (S) minus the distance that it would have moved (D), or $E=S-D$. By virtue of the present invention, a new distance is calculated for the next new velocity. This would be two inches minus the error (E) of the last distance or $D=2-E$. The new distance (D) is divided by the new time (T) for the velocity required.

As the bin array is driven in either direction to receive sheets in the respective bins, a new velocity is imparted thereto as determined by the timing between successive sheets reaching the sensors SR-4 and SR-3.

Figure 4:
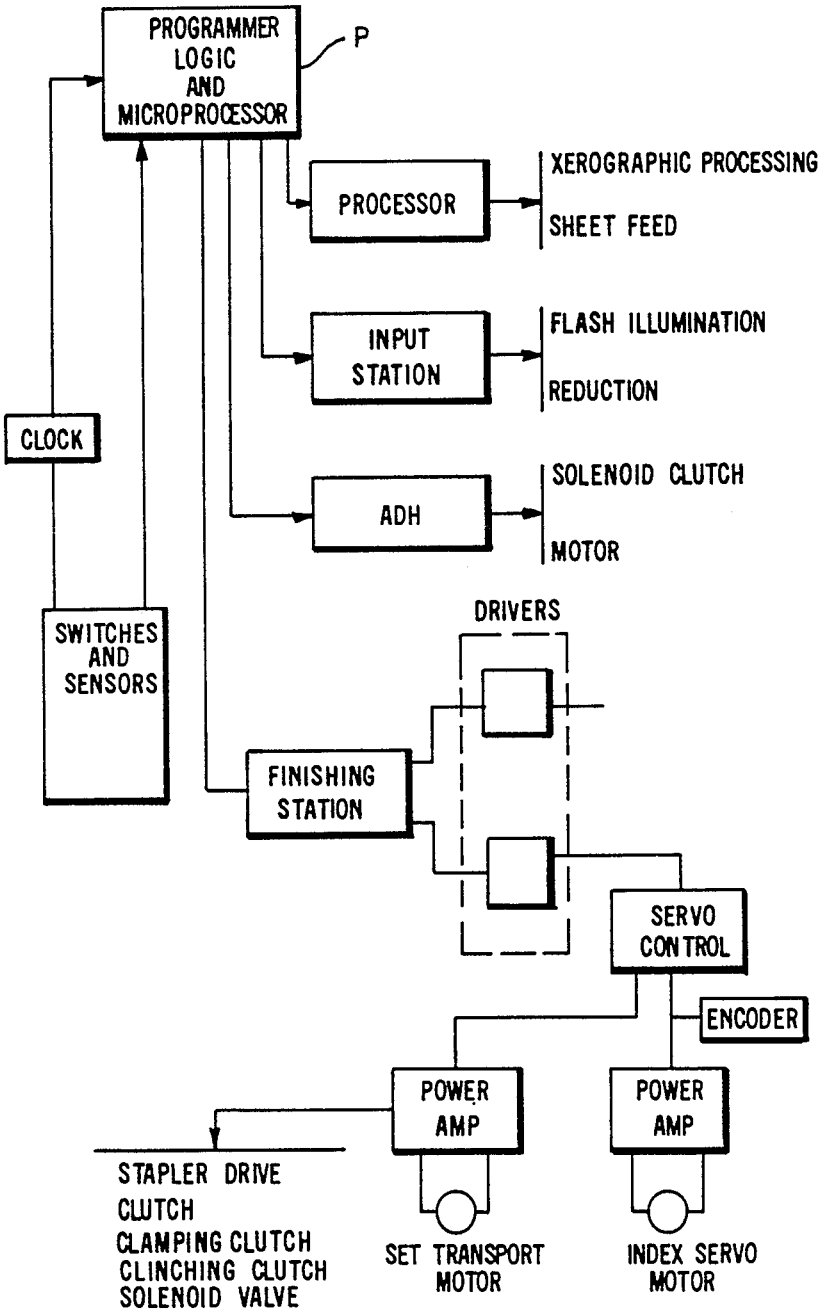
FIG. 4 is a block diagram of the control function of the present invention.

FIG. 4 is a block diagram of a control arrangement for the reproduction system in FIG. 1. The programmer P is operatively connected to four remotes: (1) the processor 11 for controlling the xerographic processing, copy sheet movement, timing and monitoring and all other parameters in the processor; (2) the input station comprising the flash illumination system and circuitry and copy size reduction if this feature is available; (3) the automatic document handling apparatus 12; and (4) the finishing station 13.

The finishing station 13 includes two drivers, one of which is operatively connected by way of relays or reediac to the various motors involved in binding booklets. The other driver is operatively connected to a servo controller which, in turn, is connected to two power amplifiers and associated circuitry. One of the power amplifiers serves to energize and operate the sorter array index motor M-1, while the other amplifier serves to energize and operate the set transport motor. As previously stated, these motors impress rather complex movements on various structures and there is a need to maintain accurate velocity profile controls. One of the power amplifiers also is operatively connected to the various clutches and solenoids in the finishing station.

A machine close is integrated into the Programmer P for use in calibrating new velocities imparted to the bin array 34 by the servo motor. The encoder for the servo motor is associated with the servo control for the servo motor.

While the invention has been described with reference to the structure disclosed, it is not confined to the details set forth, but is intended to cover such modifications or changes as may come within the scope of the following claims.

What is claimed is:

1. In a copier having a processor for reproducing information to-be-copied on copy sheets and a sorter arranged adjacent a copy receiving position to receive successive copy sheets in bins thereof and to collate the same into booklets, the improvement including:

drive means connected to said sorter for imparting indexing movement to the bins thereof relative to said copy receiving position, means for directing the copy sheets from the processor to the bins of said sorter while said bins are being indexed relative to said position, a control system comprising means for timing successive copy sheets being directed from the processor to said sorter by said directing means, and means, in communication with said timing means, for calculating a difference in time between successive copy sheets and for transmitting a signal, as a function thereof, to said drive means to adjust the indexing movement imparted to the bins of said sorter by said drive means, said drive means being responsive to the signal for accelerating or decelerating the bins of the sorter.

* * * * *